US008677689B1

(12) United States Patent
Draper et al.

(10) Patent No.: US 8,677,689 B1
(45) Date of Patent: Mar. 25, 2014

(54) SLIDING POWER LIFT AND LOCKING SYSTEM

(71) Applicant: DTS Enterprises Inc., Ellsworth, MI (US)

(72) Inventors: David L. Draper, Charlevoix, MI (US); Keith S. Attee, Charlevoix, MI (US); Thomas H. Buerkle, Jr., Kewadin, MI (US)

(73) Assignee: DTS Enterprises, Inc., Ellsworth, MI (US)

( * ) Notice: Subject to any disclaimer, the term of this patent is extended or adjusted under 35 U.S.C. 154(b) by 0 days.

(21) Appl. No.: 13/735,533

(22) Filed: Jan. 7, 2013

Related U.S. Application Data

(60) Provisional application No. 61/584,003, filed on Jan. 6, 2012.

(51) Int. Cl.
*E05F 11/02* (2006.01)

(52) U.S. Cl.
USPC ..... 49/281; 49/280; 49/340; 49/344; 49/346; 52/200

(58) Field of Classification Search
USPC ..... 49/279, 280, 281, 300, 339, 340, 341, 49/344, 346, 282, 283, 284, 285, 291, 292, 49/293, 294, 295, 296, 298, 299, 394; 52/200
See application file for complete search history.

(56) References Cited

U.S. PATENT DOCUMENTS

| | | | | | |
|---|---|---|---|---|---|
| 2,221,039 | A * | 11/1940 | Babcock | 49/139 |
| 3,461,607 | A * | 8/1969 | Anderton et al. | 49/7 |
| 4,497,135 | A * | 2/1985 | Vetter | 49/280 |
| 4,897,959 | A * | 2/1990 | Worden | 49/18 |
| 5,111,615 | A * | 5/1992 | Kuhnt et al. | 49/279 |
| 5,581,942 | A * | 12/1996 | Sill et al. | 49/253 |
| 6,122,863 | A * | 9/2000 | Tippin et al. | 49/279 |
| 6,585,303 | B1 * | 7/2003 | Coose et al. | 292/144 |
| 8,365,470 | B1 * | 2/2013 | Campbell et al. | 49/343 |

* cited by examiner

*Primary Examiner* — Jerry Redman
(74) *Attorney, Agent, or Firm* — Dykema Gossett PLLC

(57) ABSTRACT

A sliding power lift and locking assembly for lifting and locking an object includes a motor, a first drive shaft, a first drive block assembly, a first drive housing, and a link arm. The first drive shaft has a body and a cylindrical axis and is rotationally driven by the motor. The first drive block assembly includes an aperture configured to engage the body of the first drive shaft, a latch dog with a first slot configured to engage a dog catch pin associated with the object, and a slider. A portion of the first drive housing and a portion of the first drive block assembly are provided in a track of the first drive housing, and the track of the first drive housing is configured such that the first drive block assembly is configured to move in a path relative to the first drive housing. The link arm includes a first end and second end. The first end of the link arm is configured to move with the slider of the first drive block assembly, and the second end of the link arm is configured to connect to the object.

20 Claims, 13 Drawing Sheets

SLIDING POWER LIFT AND LOCKING SYSTEM

CROSS REFERENCE TO RELATED APPLICATION

This application claims the benefit of U.S. Provisional Application No. 61/584,003 entitled "Sliding Power Lift and Locking System," filed Jan. 6, 2012 (hereinafter "the '003 Application"). The '003 Application is hereby incorporated by reference in its entirety as though fully set forth herein.

TECHNICAL FIELD

This disclosure relates generally to power operating devices for hinged windows or hatch assemblies, including without limitation, power operating devices that may be used to open or close a hinged window or hatch assembly.

BACKGROUND

Generally, boats may have openings that are covered by a hatch, window, or other various types of barriers covering portals as known to those with skill in the art. Overhead window assemblies or hatches (for purposes of this disclosure, hatches and/or windows may be used interchangeably and may refer to either) used on boats are often mounted in the roof of the cabin. The hatches/windows may be oriented either horizontally or vertically and may have a hinge on one side. The position, configuration, and height of the hatches can make it difficult to reach or open because of the height or position. For example, to open a secured manual hatch commonly requires unlatching one or more latch mechanisms ("dogs"), and then the hatch must be lifted with one hand while securing a strut with the other hand. Conversely, to secure a traditional manual hatch often requires holding the hatch with one hand while disengaging the strut with the other hand. After the hatch is closed, the dogs must be manually latched to lock down the hatch to secure the opening. If the hatch is not latched down, the boat may be vulnerable to the elements or unauthorized access, or the hatch may open inadvertently. Additionally, hinged windshield assemblies generally pivot at the top and can be difficult to reach and open.

It may be desirable to provide, inter alia, a power operated and locking assembly that opens and closes a window or hatch and automatically locks and secures the window or hatch when closed.

BRIEF DESCRIPTION OF THE DRAWINGS

The accompanying drawings, which are included to provide a further understanding of the invention and are incorporated in and constitute a part of this specification, illustrate embodiments of the invention and, together with the detailed description, serve to explain aspects and features of the inventive concepts. In the drawings.

BRIEF SUMMARY OF THE INVENTION

Figure 1:
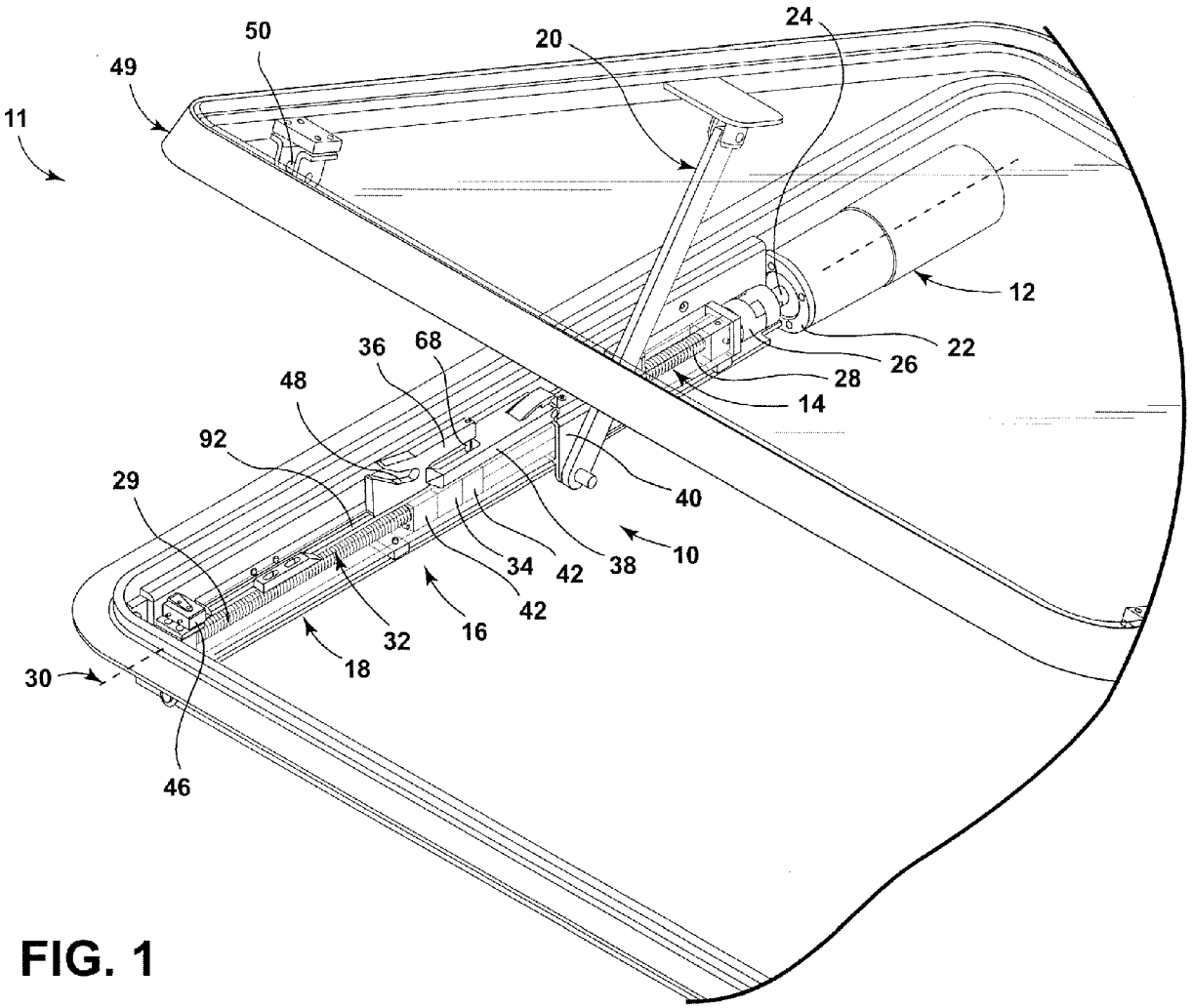
FIG. 1 generally represents an embodiment of a sliding power lift and locking assembly in an open position showing use of one motor.

The present disclosure describes an embodiment of a sliding power lift and locking assembly for lifting and locking an object, the assembly comprising: a motor; a first drive shaft, wherein the first drive shaft has a body and a cylindrical axis and the first drive shaft is rotationally driven by the motor; a first drive block assembly, wherein the first drive block assembly includes an aperture configured to engage the body of the first drive shaft, a latch dog with a first slot configured to engage a dog catch pin associated with said object, and a slider; a first drive housing, wherein a portion of the first drive shaft and a portion of the first drive block assembly are provided in a track of the first drive housing, and wherein the track of the first drive housing is configured such that the first drive block assembly is configured to move in a path relative to the first drive housing; and a link arm including a first end and a second end, wherein the first end of the link arm is configured to move with the slider of the first drive block assembly, and the second end of the link arm is configured to connect to said object.

The first drive block assembly may comprise a slider latch connected to the slider and configured to engage with the latch dog. The latch dog may include a second slot configured to engage with a first end of the slider latch, wherein a second end of the slider latch is configured to connect with the slider. The second slot of the latch dog may be L-shaped and a bottom portion of the second slot may be configured to receive a portion of the first end of the slider latch. The assembly may comprise a slider latch spring configured to bias the slider latch toward the bottom portion of the second slot. The slider latch includes a slot and the latch dog includes a pin configured to engage with the slot of the slider latch. In another aspect of the invention, the first drive housing may comprise a trip wedge configured to disengage the slider latch from the latch dog. The first drive housing may comprise a trip wedge configured to move the first end of the slider latch out of the bottom portion of the second slot. The assembly may also comprise a limit switch configured to stop the motor.

The first slot of the latch dog may have a medial axis at an angle relative to the cylindrical axis of the first drive shaft. In another aspect of the invention, the first slot of the latch dog may include a first portion with a first medial axis at a first angle relative to the cylindrical axis of the first drive shaft and a second portion with a second medial axis at a second angle relative to the cylindrical axis of the first drive shaft, wherein the first angle and second angle are different.

The latch dog may be connected to the aperture of the first drive block assembly such that the latch dog is configured to move with the aperture in a path along the first drive shaft. The latch dog may also be configured to move independently of the slider latch when the latch dog and the slider latch are disengaged, and the slider latch may be configured to move with the latch dog when the slider latch and the latch dog are engaged. The first end of the link arm may be pivotally connected to the slider, and the second of the link arm may be pivotally connected to said object.

In an embodiment, the assembly may also comprise a second drive shaft, a second drive block assembly, a second drive housing, and a drive synchronizer configured to facilitate the motor to drive the first drive block assembly and the second drive block assembly. The drive synchronizer may comprise a first drive belt pulley connected to the first drive shaft, a second drive belt pulley connected to the second drive shaft, and a drive belt disposed between the first drive shaft and second drive shaft. In an embodiment, the assembly may comprise a belt tensioner. In another embodiment, the drive synchronizer may comprise a first bevel gear connected to the first drive shaft, a second bevel gear connected to the second drive shaft, a corresponding first bevel gear, a corresponding second bevel gear, and a drive synchronizer shaft disposed between the first drive shaft and second drive shaft and connected to the corresponding first bevel gear and corresponding second bevel gear.

In an aspect of the invention, the cross-section of the portion of the first drive block assembly provided in the track of the first drive housing may have substantially the same peripheral shape as the cross-section of the track of first drive housing.

In embodiment, the first drive shaft may be threaded, and the aperture of the first drive block assembly may be threaded, wherein the rotation of the first drive shaft causes the latch dog to move along the track of the first drive housing.

Additional features, advantages, and embodiments may be set forth or become apparent from consideration of the following detailed description, drawings, and claims. Moreover, it is to be understood that both the foregoing summary and the following detailed description are exemplary only and intended to provide explanation without limiting the scope of the invention as claimed.

DETAILED DESCRIPTION

Reference will now be made in detail to embodiments of the present disclosure, examples of which are described herein and illustrated in the accompanying drawings. While the invention will be described in conjunction with embodiments, it will be understood that they are not intended to limit the present disclosure to these embodiments. On the contrary, the present disclosure is intended to cover alternatives, modifications and equivalents, which may be included within the spirit and scope of the present disclosure. Referring to the accompanying drawings (FIGS. 1-14), one embodiment of a sliding power lift and locking assembly 10 for a pivoting hatch or window assembly 11 may comprise a motor 12, a first drive shaft 14, a first drive block assembly 16, a first drive housing 18, and a first link arm 20.

Referring to FIG. 1, the motor 12 may be any form or type of motor capable of rotating the first drive shaft 14 as known to those with skill in the art. For example, and without limitation, the motor 12 may be an electric motor. The motor 12 may be connected to a motor mount 22 where the motor mount 22 may support and locate the motor 12 relative to the sliding power lift and locking assembly 10. The motor 12 may be substantially cylindrical in shape. Although a cylindrical shape is mentioned, the motor 12 may comprise other various shapes as known to those with skill in the art. An output shaft 24 of the motor may be connected and/or attached to a motor coupling 26. The motor coupling 26 may engage the first drive shaft 14 such that the first drive shaft 14 is rotated when the motor output shaft 24 is in motion. The motor coupling 26 may be attached or connected to the first drive shaft 14.

The first drive shaft 14 may comprise a long cylindrical threaded shaft. The threads may, for example, have an acme-type thread. Although an acme thread is mentioned in detail, the threads may comprise other various thread patterns as known to those with skill in the art. A first end 28 of the first drive shaft 14 may be connected directly or indirectly to the motor 12. The motor 12 may rotate about a cylindrical axis 30 of the first drive shaft 14. The first drive shaft 14 may be made of metal. Although metal material of the first drive shaft 14 is mentioned in detail, the first drive shaft 14 may comprise other various materials as known to those with skill in the art. A substantial portion of the first drive shaft 14 may be located in a track 32 (shown as transparent in FIG. 1) of the first drive housing 18 (described further below).

Figure 14:
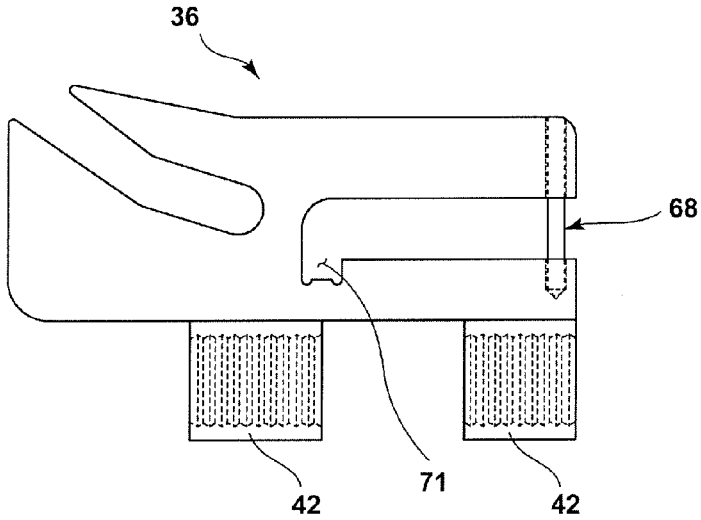
FIG. 14 is a side view of the latch dog of FIG. 13.

The first drive block assembly 16 may comprise a drive nut 34, a latch dog 36, a slider latch 38, and a slider 40. The drive nut 34 has a threaded hole (not shown) that corresponds to the threads on the first drive shaft 14. The body of the first drive shaft 14 may be placed through the threaded hole of the drive nut 34, and the threads in the threaded hole may engage the threads on the first drive shaft 14. In an embodiment, the drive nut 34 may be integrated with a latch dog base 42. In another embodiment, the drive nut 34 may be a separate component that may be attached to the latch dog 42. For example, as best seen in FIG. 14, the latch dog base 42 may have two portions, and the drive nut 34 may be disposed therebetween. In an embodiment, the latch dog base 42 and drive nut 34 may have a square cross sectional shape to correspond with a square cross sectional shape of the track 32 of the first drive housing 18. The shape of the latch dog base 42 and drive nut 34 relative to the track 32 of the first drive housing 18 may prevent the latch dog 16 and drive nut 34 from rotating with the first drive shaft 14. Although a square cross sectional shape of the first drive shaft 14 and the corresponding track 32 of the first drive housing 18 is mentioned in detail, the cross sectional shapes of the latch dog base 42 and drive nut 34 and first drive shaft 14 may comprise other various cross sectional shapes as known to those with skill in the art. In an embodiment, a substantial portion of the latch dog base 42 and drive nut 34 of the first drive block assembly 16 may be located in the track 32 of the first drive housing 18. The engagement of the drive nut 34 of the first drive block assembly 16 to the threads of the first drive shaft 14 may allow rotational motion to be translated into linear motion. When the first drive shaft 14 is rotated about cylindrical axis 30, the first drive block assembly 16 may move along a substantially linear path where the linear path is parallel to the cylindrical axis 30 of the first drive shaft 14. For example, when the first drive shaft 14 is rotated in one direction, the first drive block assembly 16 may move in a linear direction toward the first end 28 of the first drive shaft 14. If the first drive shaft 14 is rotated in the opposite direction, the first drive block assembly 16 may move in an opposite linear direction toward a second end 29 of the first drive shaft 14. In an embodiment, a portion of the drive nut 34 and/or latch dog base 42 of the first drive block assembly 16 may comprise a material that reduces friction between the nut 34 and/or latch dog base 42 and the first drive housing 18. In an embodiment, the portion of the nut 34 and/or latch dog base 42 may be coated with a lubricant as known to those with skill in the art. The first drive block assembly 16 may engage a limit switch 46 which will stop the motor 12 and thereby stop the first drive block assembly 16 from further movement in that direction. The limit switch 46 may be in the position in which the hatch or window 49 is fully closed and securely latched. Additionally, while limit switches 46 are disclosed herein, it is noted that other forms and types of positional sensing devices known in the art may be included in addition to, or in lieu of, various switches disclosed herein.

Figure 3:
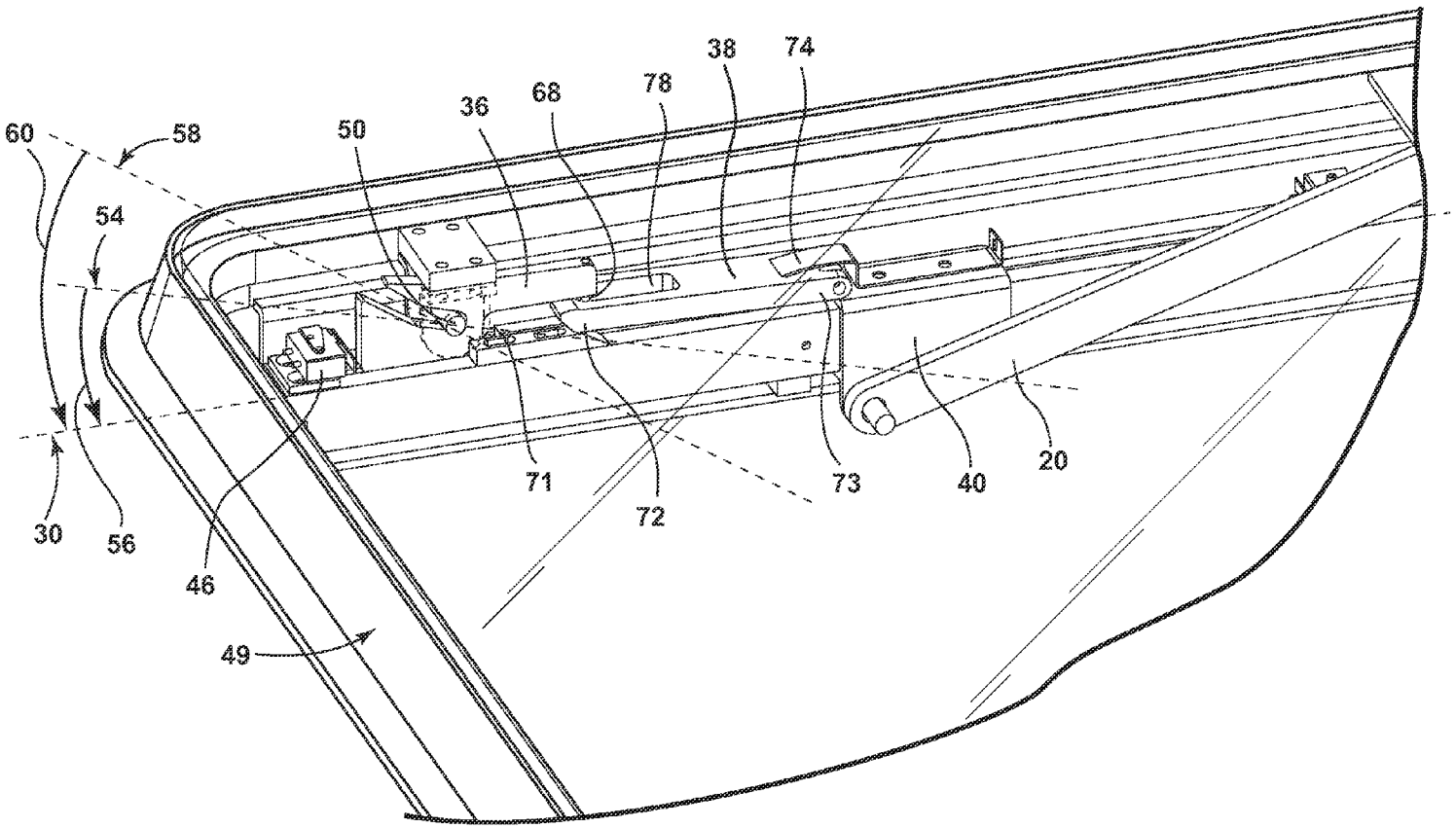
FIG. 3-11 are illustrations of the sliding power lift and locking assembly of FIG. 1 during various positions of the opening/closing cycle.

Referring to FIG. 3, the latch dog 36 of the first drive block assembly 16 may protrude outside of the first drive housing 18. The latch dog 36 may move with the drive nut 34 of the first drive block assembly 16. The latch dog 36 may have a first groove or slot 48 (hereinafter a groove or slot being simply referred to as a "slot") configured to engage a dog catch pin 50 located on a hatch cover or a window 49 of the pivoting boat hatch or window assembly 11. The first slot 48 may be configured such that a first medial axis 54 of the first slot 48 is at a first angle 56 relative to the cylindrical axis 30 of the first drive shaft 14. In another embodiment, a first slot 48 may be configured such that the medial axis 54 of the first slot 48 has at least two different angles relative to the cylindrical axis 30 of the first drive shaft 14. For example, a first slot 48 may have two medial axes 54, 58 relative to the cylindrical axis 30 of the first drive shaft 14. In other words, the first slot 48 need not be completely straight, but may include a bend. The first medial axis 54 may be at first angle 56, and the second medial axis 58 may be at a second angle 60 relative to the cylindrical axis 30 of the first drive shaft 14. In an embodiment, the first angle 56 may be less than the second angle 60. For example, as the first slot 48 of the latch dog 36 first engages the dog catch pin 50, the dog catch pin 50 can enter through an opening in the first slot 48 and start to move or slide in the first slot 48 along a second medial axis 58. As the first drive block assembly 16 continues in a direction away from the motor 12, the dog catch pin 50 may continue to slide deeper into the first slot 48 until the dog catch pin 50 moves in a direction along the first medial axis 54. The change in the angles 56, 60 of the medial axes 54, 58 of the first slot 48 may allow for various acceleration/deceleration of the opening and closing speed of the hatch or window 49. For example, and without limitation, when the hatch or window 49 is opened, the first drive block assembly 16 may move in a direction toward the motor 12 at a constant speed. By configuring a change in angle of a first slot 48 medial axis, the opening speed of the hatch or window 49 may be changed (e.g., accelerate) to allow an easier "break" from a hatch or window seal. The use of the first slot 48 of the latch dog 36 may provide a mechanical advantage that may compress the seal of a hatch or window assembly 11, thereby permitting the hatch or window assembly 11 to be securely latched. Further, for some embodiments, the dog catch pin 50 may comprise a removable pin which may be removed to manually disengage the hatch or window 49 from the latch dog 36.

Figure 4:
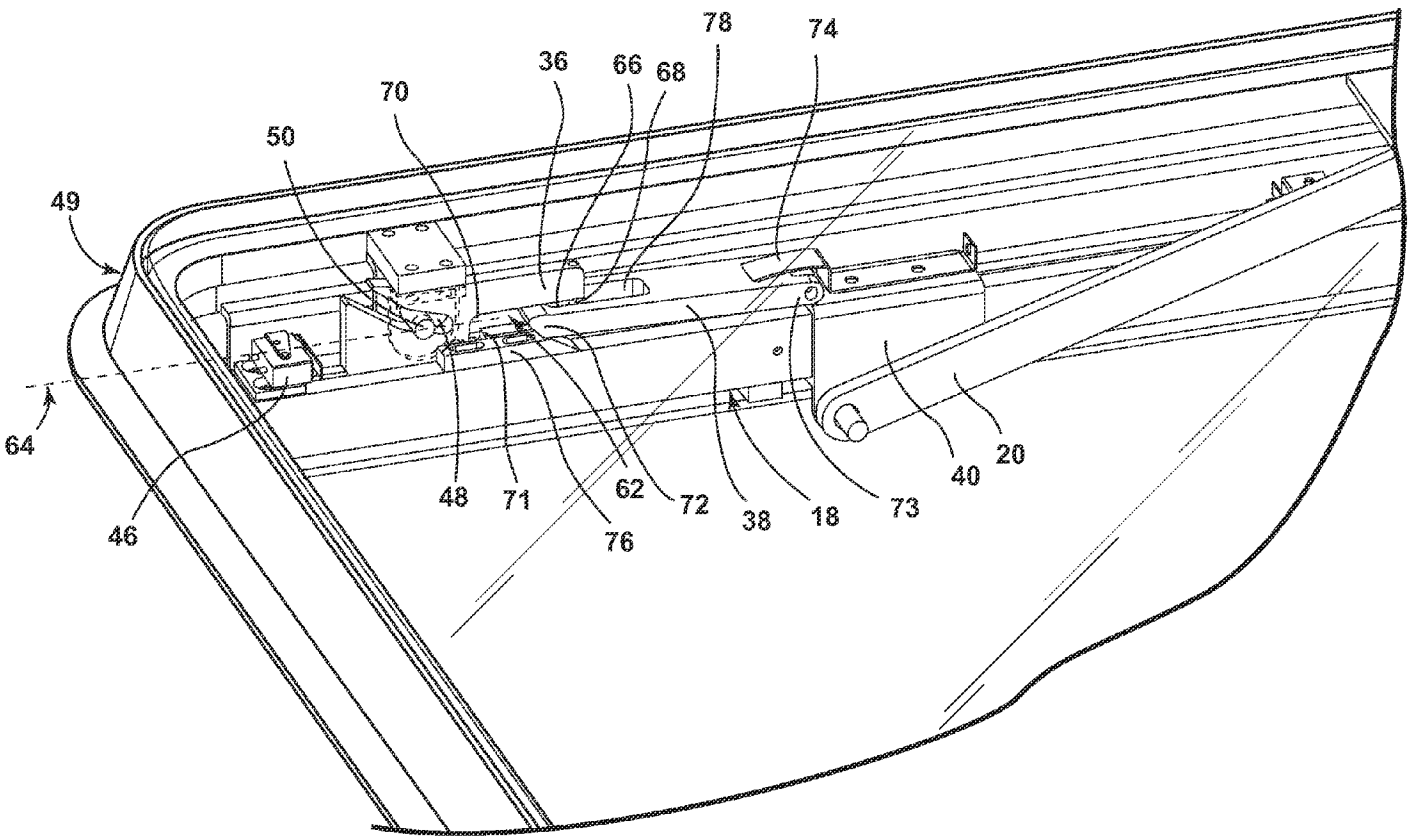
Figure 5:
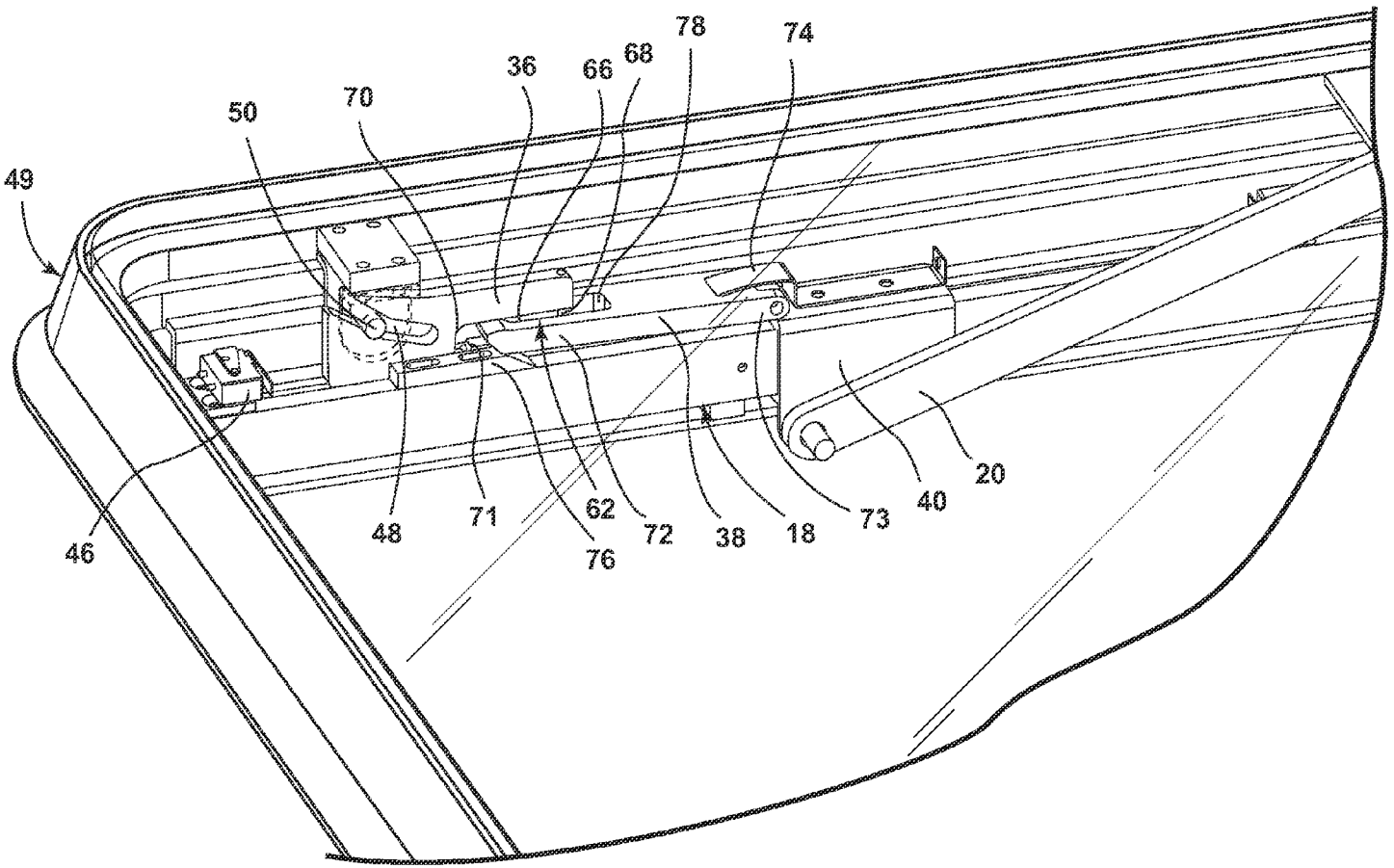
Figure 6:
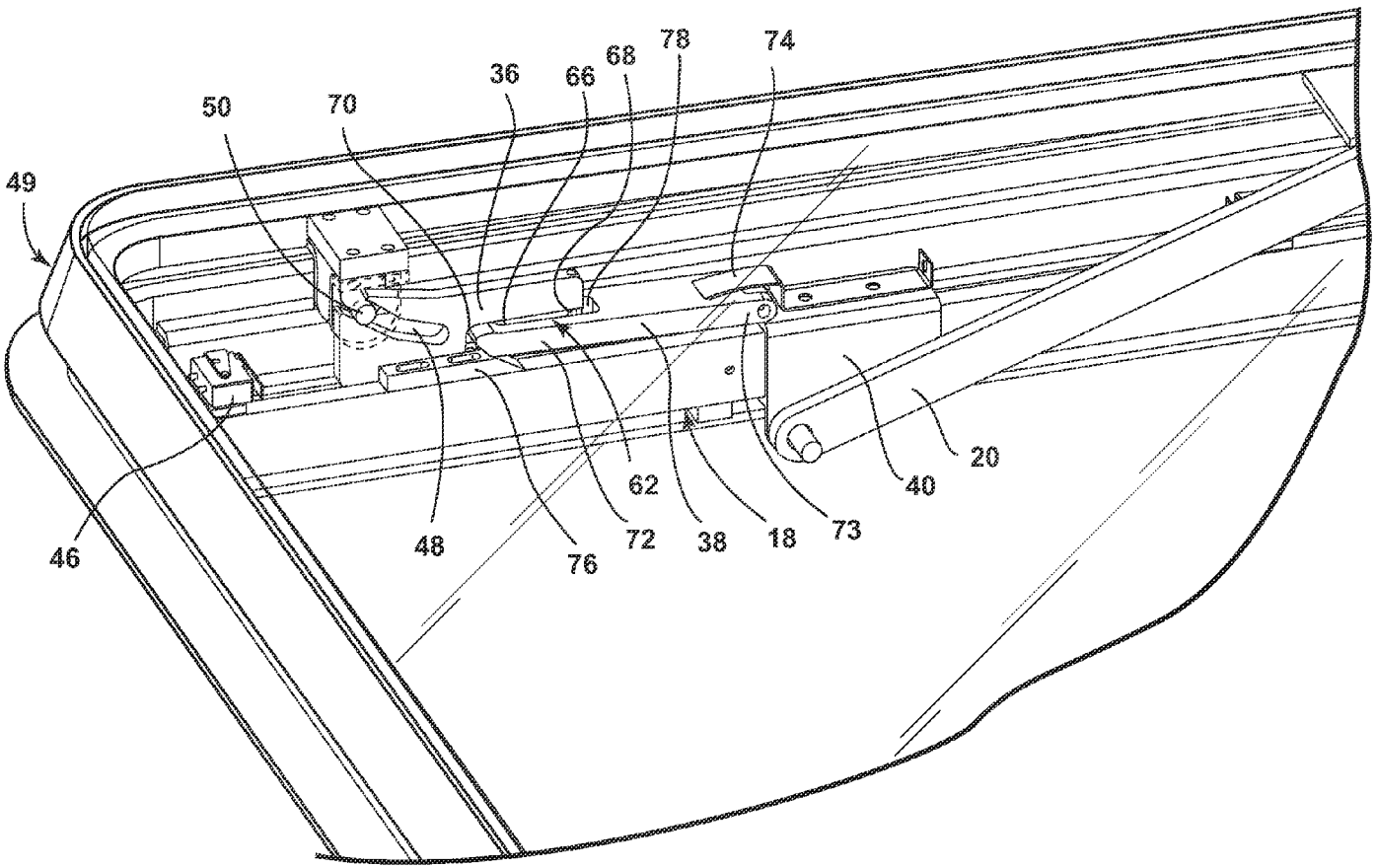
Figure 13:
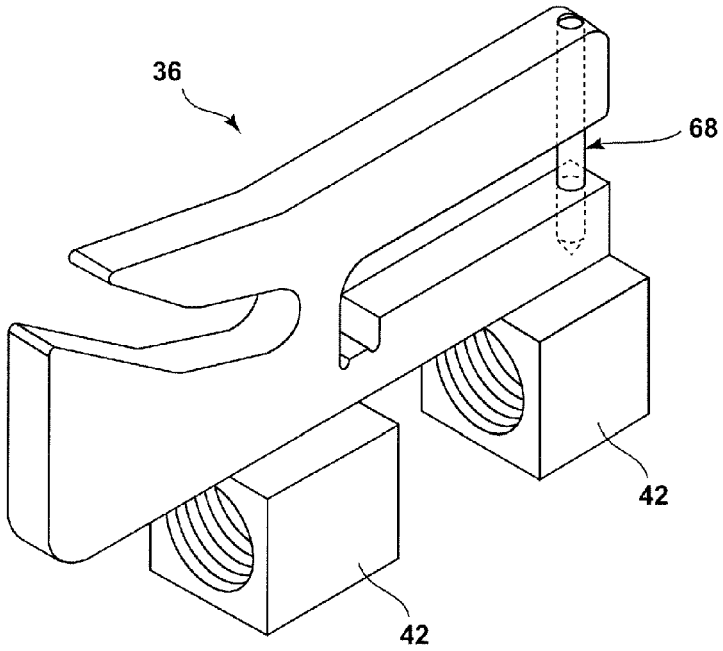
FIG. 13 is a perspective view of a latch dog.

Referring to FIG. 4, in embodiments, the latch dog 36 may include a second slot 62 that can be configured to receive the slider latch 38. A medial axis 64 of the second slot 62 may be substantially parallel to the cylindrical axis 30 of the first drive shaft 14. In an embodiment, a first end 66 of the second slot 62 may be open so that the slider latch 38 may be positioned into the second slot 62. In another embodiment, the first end 66 of the second slot 62 may be configured to include a pin 68 (as best seen in FIGS. 13 and 14) that closes the first end 66 of the second slot 62 after the slider latch 38 is positioned. A second end 70 of the second slot 62 may include a recess or cutout 71 (e.g., forming approximately an "L-shape" to the second slot), and the recess or cutout 71 may be directed away from the hatch or window 49 (as best seen in FIGS. 13 and 14).

Figure 7:
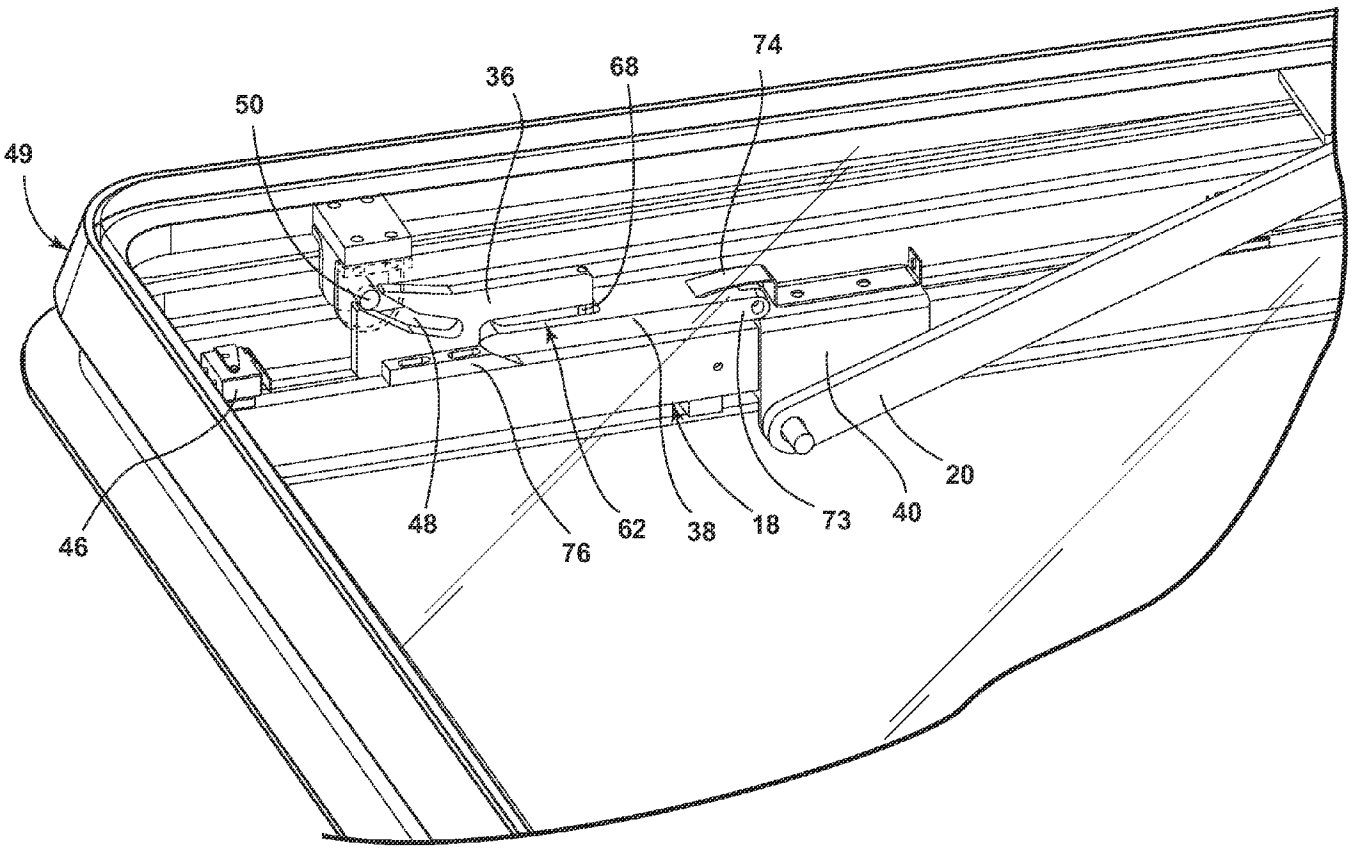
Figure 8:
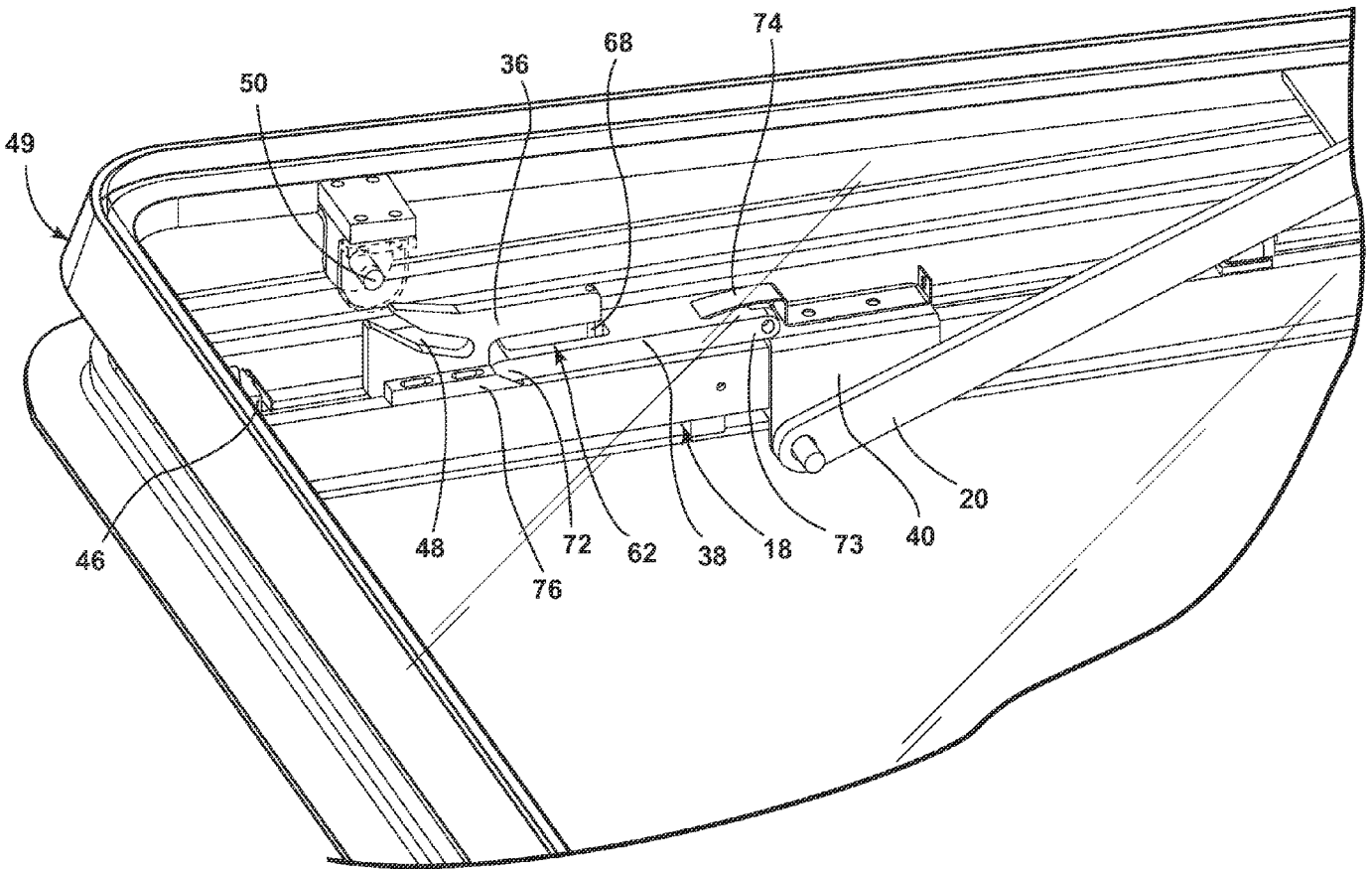
Figure 9:
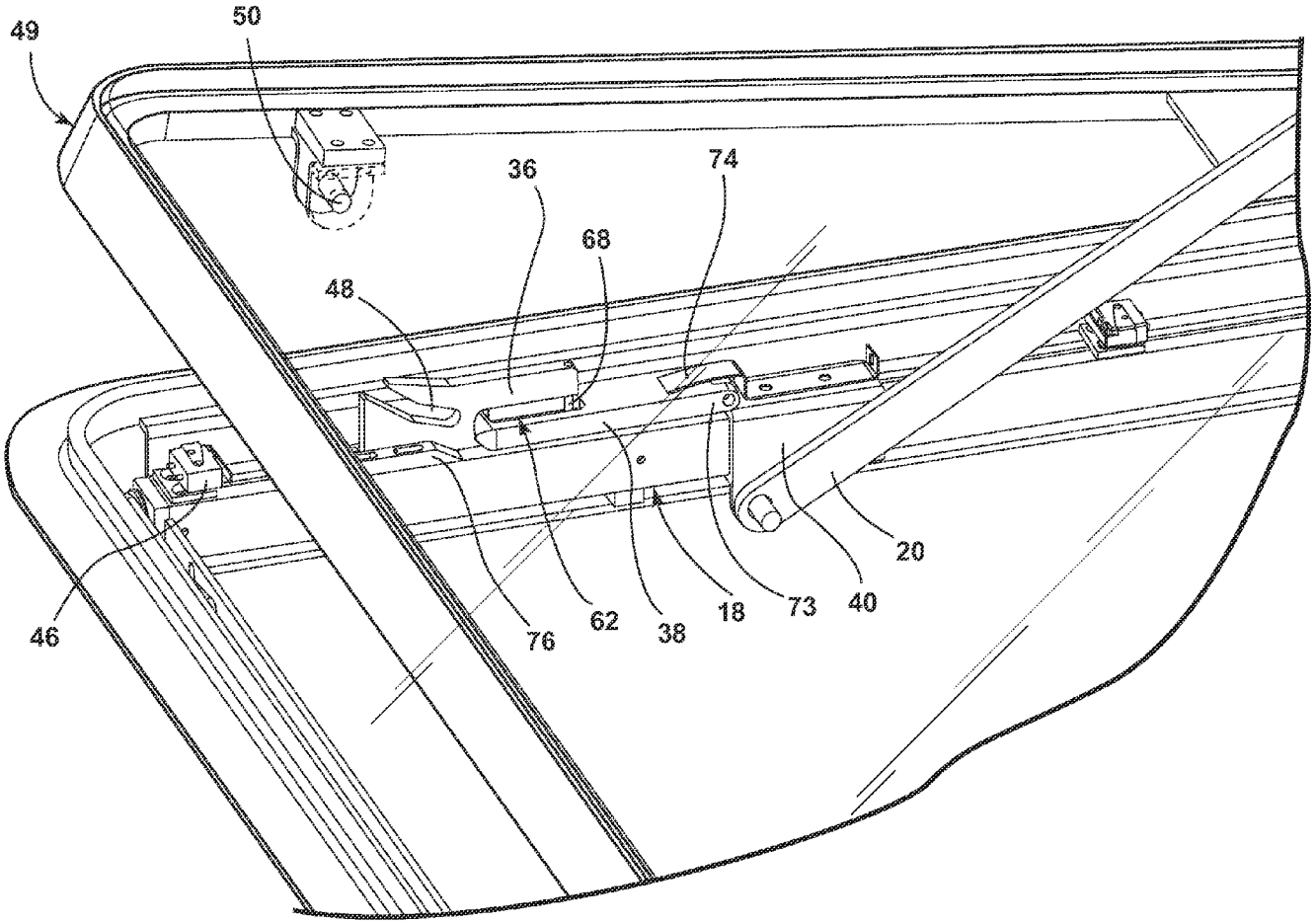

For some embodiments, the slider latch 38 of the first drive block assembly 16 may be connected to the latch dog 36. At certain times during the opening/closing cycle, a first end 72 of the slider latch 38 may be positioned in the cutout 71 in the second slot 62 of the latch dog 36. When positioned in the cutout 71, the slider latch 38 may move simultaneously with the latch dog 36 (as best seen in FIG. 9). The slider latch 38 may be biased to remain in the cutout 71 in the second slot 62 of the latch dog 36, such as by use of a slider latch spring 74. In an embodiment, a slider latch spring 74 may comprise a leaf spring. While a leaf spring has been mentioned in detail, other types of biasing mechanisms may be used as known to those with skill in the art. The slider latch 38 may include a slot 78 at a first end 72 of the slider latch 38 that may be slightly wider than the width of the latch dog 36. The slider latch 38 may also be configured to permit the slider latch 38 to disengage from the latch dog 36 as the first drive block assembly 16 nears the limit switch 46 and/or the hatch or window 49 becomes closed. For example, without limitation, a slider latch 38 may contact a trip wedge 76 located on the first drive housing 18. When the slider latch 38 contacts the trip wedge 76, the slider latch 38 may begin to be lifted out of the cutout 71 in the second slot 62 of the latch dog 36 and may, thus, disengage from the latch dog 36 (as best seen in FIG. 8). In an embodiment, the trip wedge 76 may be configured so that the slider latch 38 disengages from the latch dog 36 approximately when the hatch or window 49 is closed or substantially closed. Referring to FIG. 7, in embodiments, when the slider latch 38 disengages or substantially disengages from the cutout 71 in the second slot 62 of the latch dog 36, the first slot 48 of the latch dog 36 may approximately begin to engage the dog catch pin 50 provided in connection with the hatch/window 49. The latch dog 36 may continue to move in a direction away from the motor 12, for instance, until the dog catch pin 50 is moved or driven further into the first slot 48 of the latch dog 36 and the latch dog 36 activates a sensor or limit switch 46 that (e.g., upon contact) will stop the motor 12 and/or the related travel in that direction. The motion of the latch dog 36 and drive nut 34 during the period when the slider latch 38 is disengaged from the latch dog 36 may allow the sliding power lift and locking assembly 10 to, for instance, either latch and secure the hatch or window 49, or unlatch and unsecure the hatch or window 49, depending on the direction of the movement of the latch dog 36 and drive nut 34. Although a detailed shape of the slider latch 38 is mentioned in detail, the slider latch 38 may comprise other various shapes as known to those with skill in the art. In an embodiment, a second end 73 of the slider latch 38 may be configured to be pivotally connected to the slider 40. A pivotal connection allows the slider latch 38 to pivot in and out of the cutout 71 in the second slot 62 of the latch dog 36.

FIG. 3 shows the sliding power lift and locking assembly 10 in a closed position. In the closed position, the slider latch 38 may be disengaged from the latch dog 36 since the first end 72 of slider latch 38 is not disposed in the cutout 71. In an embodiment, when the first end 72 of the slider latch 38 is not disposed in the cutout 71, the latch dog 36 may move independently of the slider latch 28. In other words, when the first drive shaft 14 rotates and the hatch or window 49 is going from closed to open, only the latch dog 36 may translate along track 12 of the first drive housing 18. The slider latch 38 remains stationary until the first end 72 of the slider latch 38 is biased downwards into the cutout 71 (via slider latch spring 74). Once engaged, the slider latch 38 moves with the latch dog 36 along track 12 of the first drive housing 18. Because the slider 40 is connected to the slider latch 38, the slider 40 also translates and thus causes the first link arm 20 to pivot and open the hatch or window 49. Even in a disengaged state (i.e., when the first end 72 of the slider latch 38 is not disposed in the cutout 71), the slider latch 38 and the latch dog 36 may still be connected since the pin 68 of the latch dog 36 remains in the slot 78 of the slider latch 38 (albeit at different positions) during the opening/closing cycle.

As the first end 72 of the slider latch 38 moves closer to the cutout 71 (as can be seen sequentially in FIGS. 3-8), the dog catch pin 50 may move along and eventually out of the first slot 48 of the latch dog 36. In an embodiment, the dog catch pin 50 is free from the first slot 48 (and thus the seal of the window 49 is broken) around the same time as when the first end 72 of the slider latch 38 biases downward into the cutout 71 (or slightly before). Once the first end 72 of the slider latch 38 is disposed in the cutout 71, the hatch or window 49 may pivot open. Also, the pin 68 of the latch dog 36 may reach the end of the slot 78 of the slider latch 38 (toward the second end 73 of the slider latch 38) at or near the same time as when the first end 72 of the slider latch 38 reaches the cutout 71.

Once the first end 72 of the slider latch 38 is disposed in the cutout 71 and/or the pin 68 reaches the end of slot 78 of the slider latch 38, the latch dog 36 and the slider latch 38 may simultaneously move or translate together, and the first end 72 of the slider latch 38 may also be able to pivot downwards along a ramp of the trip wedge 76. The connection point between the slider latch 38 and the slider 40 may make this pivoting action possible.

Referring to FIG. 8, as the slider latch 38 nears the end of the trip wedge 76, the slider latch spring 74 may bias the first end 72 of the slider latch 38 toward the cutout 71. Once the slider latch 38 is no longer disposed on the trip wedge 76 (as seen in FIG. 9), the first end 72 of the slider latch 38 is able to move downwards into the cutout 71 via the slider latch spring 74.

The first drive shaft 14 may drive the movement necessary for both the latching and pivoting (opening and closing) of the hatch or window 49. In an embodiment, latching and unlatching the window may be made possible via the latch dog 36, dog catch pin 50, and drive nut 34, while the pivoting (opening and closing) may be made possible via the latch dog 36, slider latch 38, slider latch spring 74, slider 40, and first link arm 20. The first drive shaft 14 may drive the motion of all of the necessary components for the sliding power lift and locking assembly to function.

Referring to FIG. 7, the slider 40 of the first drive block assembly 16 may engage the first drive housing 18. In an embodiment, the slider 40 may be connected to the first drive housing 18 and/or may be configured to move substantially linearly along a path parallel to the cylindrical axis 30 of the first drive shaft 14 (as best seen in FIG. 1). The slider 40 can be configured to move simultaneously with the slider latch 38 and/or to pivotally connect to a first link arm 20.

Figure 10:
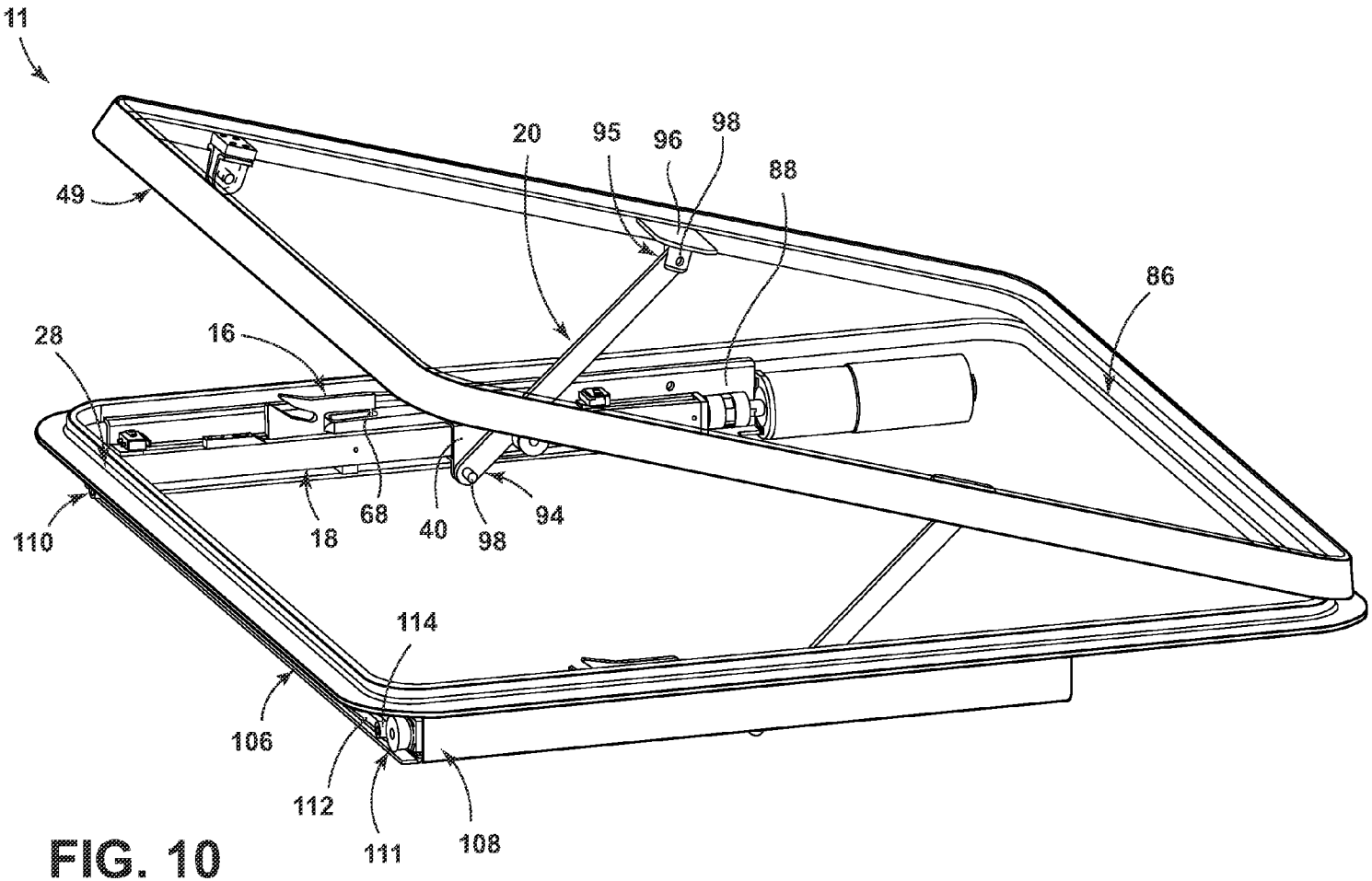

Referring to FIG. 10, the first drive housing 18 may be configured to be connected to the hatch or window assembly 11 along one of the adjacent sides to the hinge side 86 via a drive mount bracket 88. With embodiments, the first drive housing 18 may be substantially rectangular in shape. As mentioned, the first drive housing 18 may include a track 32. The track 32 may, if desired, be an internal track. Referring now to FIG. 1, the track 32 may optionally have a substantially square cross section and may be configured to provide slip fit clearance to the latch dog base 42 and the drive nut 34 of the first drive block assembly 16, for example, such that the first drive block assembly 16 may move along a linear path parallel to the cylindrical axis 30 of the first drive shaft 14. The first drive housing 18 may have a "thru slot" 92 that may be provided along a top surface of the first drive housing 18. The thru slot 92 may be configured to allow the latch dog 36 of the first drive block assembly 16 to protrude outside the first drive housing 18. The first drive housing 18 may have a square cross section. Although various shapes have been mentioned in detail, the first drive housing 18 may comprise other shapes as know to those with skill in the art in accordance with the present disclosure.

Figure 12:
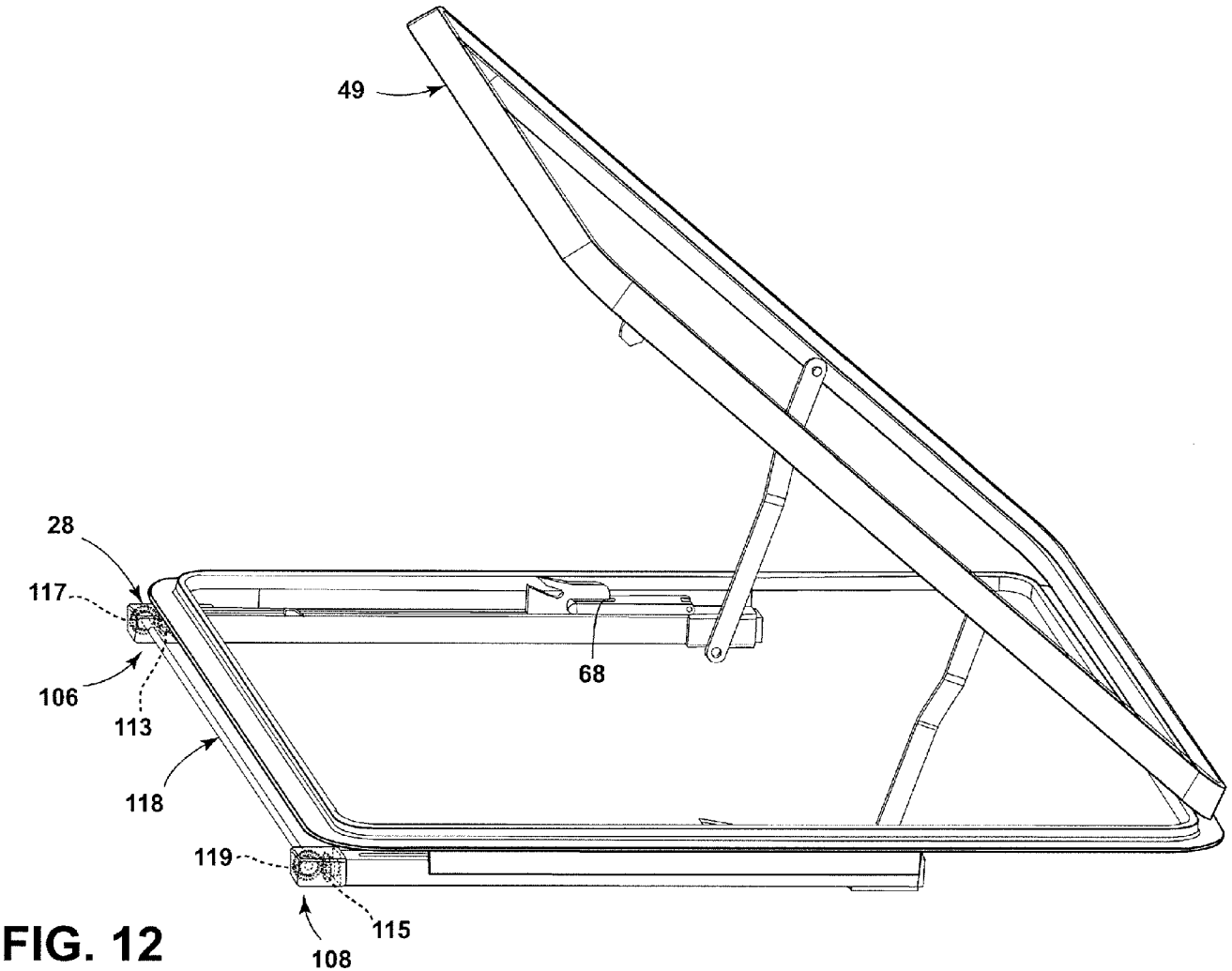
FIG. 12 is another embodiment of a sliding power lift and locking assembly in an open position showing use of a plurality of gears and a synchronization shaft.

Referring back to FIG. 10, in embodiments, a first link arm 20 can connect the first drive block assembly 16 to the hatch or window 49. The first link arm 20 may be configured to pivotally connect to the slider 40 near a first end 94 of the first link arm 20. The hatch or window 49 may be configured to include a first link mount 96, and the first link arm 20 may, if desired, be configured to pivotally connect to the hatch or window 49 at or near a second end 95 of the first link arm 20 and first link mount 96. The pivotal connections may optionally include a removable pin 98. If included, a removable pin 98 may be removed to disconnect the first link arm 20 from the first link mount 96. In an embodiment, the first link arm 20 may be substantially rectangular in shape. For some embodiments, portions or ends 94, 95 of the first link arm 20 may be rounded. While a rectangular shape with rounded ends is mentioned in detail, the first link arm 20 may have other various shapes in accordance with the present disclosure as known to those with skill in the art. The first link arm 20 may be straight from end 94 to end 95, be curved, or include a bend as shown in FIG. 12. While the first link arm 20 may be pivotally connected to both the first drive block assembly 16 and the first link mount 96 on the hatch or window 49, the motion of the first drive block assembly 16 may cause the hatch or window 49 to open or close about the hinge 86 of the hatch or window assembly 11. In embodiments, the first link arm 20 may generally function much as a strut would in connection with a traditional manual hatch or window assembly.

Figure 2:
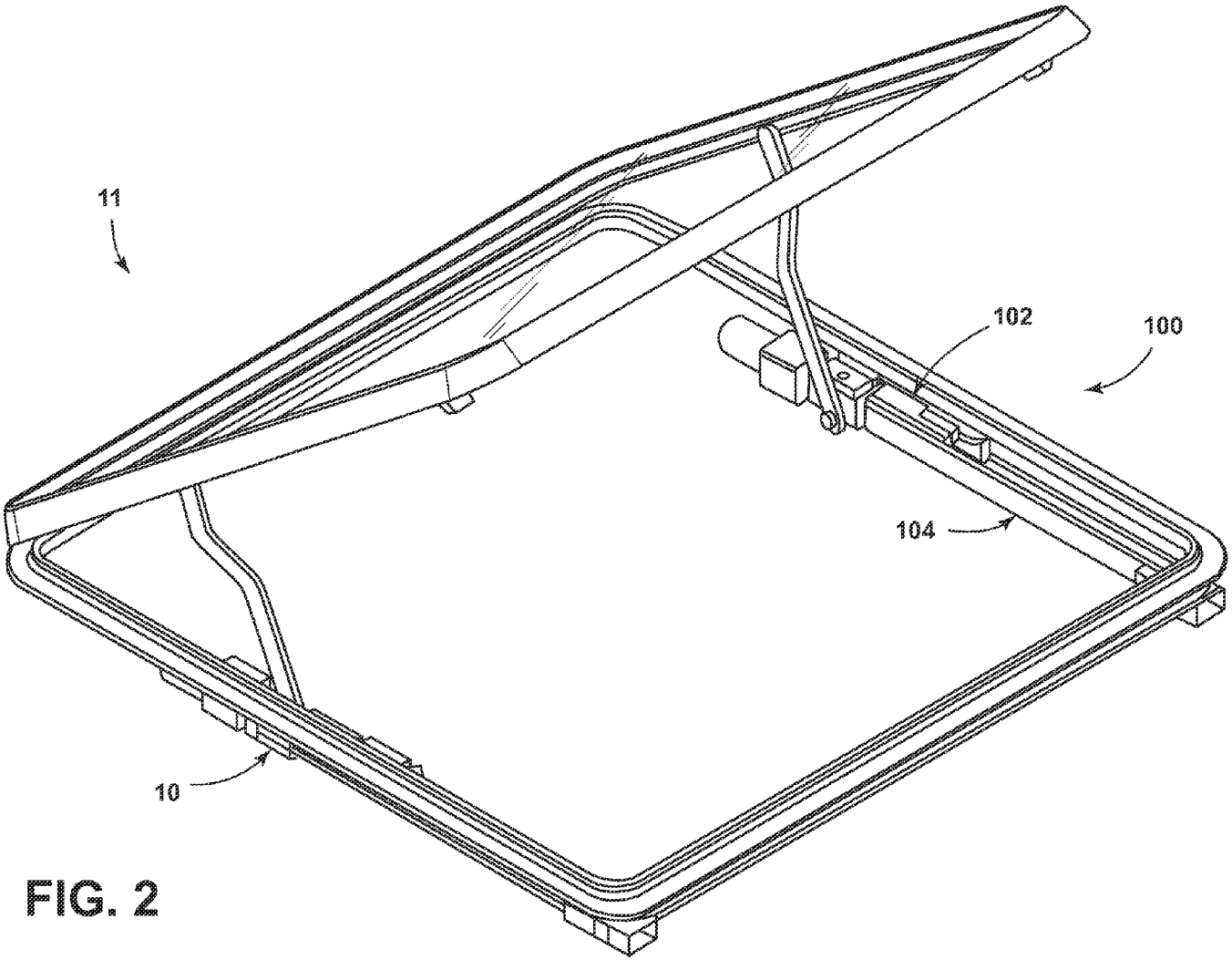
FIG. 2 generally represents another embodiment of a sliding power lift and locking assembly in an open position showing use of two motors.
Figure 11:
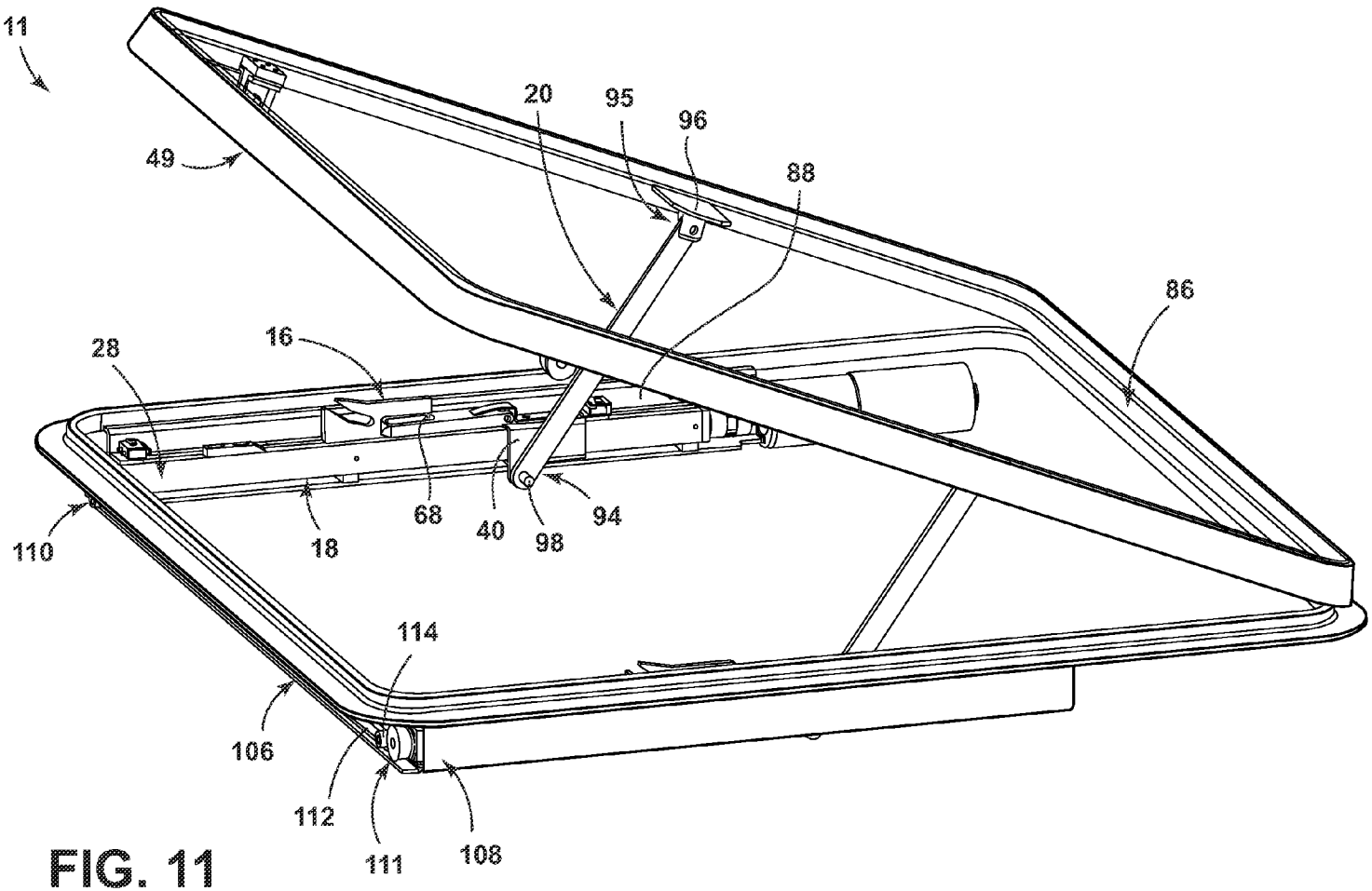

Referring to FIG. 2, in another embodiment the sliding power lift and locking assembly 10 for a pivoting hatch or window assembly 11 may comprise the motor 12, the first drive shaft 14, the first drive block assembly 16, the first drive housing 18, the first link arm 20, and a second drive shaft (not shown), a second drive block assembly 102, a second drive housing 104, and a drive synchronizer 106. The second drive shaft, the second drive block assembly 102, and the second drive housing 104 may include the same or similar features and functions as previously disclosed for the corresponding first drive shaft 14, first drive block assembly 16, and first drive housing 18. In other words, instead of one sliding power lift and locking assembly 10, the hatch or window assembly 11 could include two sliding power lift and locking assemblies 10, 100. In an embodiment, instead of using two motors (as shown in FIG. 2), the drive synchronizer 106 may provide motion to the second sliding power lift and locking assembly 100, thereby requiring only a single motor 12 to drive both assemblies 10, 100. Referring to FIG. 11, in an embodiment, the drive synchronizer 106 may be connected to the first end 28 of first drive shaft 14 and a first end 108 of the second drive shaft. The first ends 28, 108 of the first drive shaft 14 and the second drive shaft may be configured, for example, with a first and second drive belt pulley 110, 111, respectively, and pulleys 110, 111 may be connected to a drive belt 112. The drive synchronizer 106 may optionally include a belt tensioner 114 that may be configured to keep substantially constant tension on the drive belt 112. When the motor 12 rotates the first drive shaft 14, the rotation may, for instance, also be transferred to a second drive shaft. Such a configuration can provide both motion to the second drive shaft from the motor 12 connected to the first drive shaft 14 and synchronize the rotational speed of the first drive shaft 14 and second drive shaft. Referring to FIG. 12, in another embodiment, the first ends 28, 108 of the first drive shaft 14 and second drive shaft may be configured with a bevel gear 113, 115. A pair of corresponding bevel gears 117, 119 may, for example, be attached to a driver synchronizer shaft 118. When the motor 12 rotates the first drive shaft 14, the rotation may also be transferred to the second drive shaft. While pulley/belt or gear/shaft drive configuration synchronizing devices have been mentioned in detail, the drive synchronizer may comprise other types of drive synchronizing devices as known to those with skill in art. The motor 12 may provide rotational motion to either the first drive shaft 14 or the second drive shaft and mounted accordingly.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A sliding power lift and locking assembly for lifting and locking an object, the assembly comprising:

a motor;

a first drive shaft, wherein the first drive shaft has a body and a cylindrical axis and the first drive shaft is rotationally driven by the motor;

a first drive block assembly, wherein the first drive block assembly includes an aperture configured to engage the body of the first drive shaft, a latch dog with a first slot configured to engage a dog catch pin associated with said object, and a slider;

a first drive housing, wherein a portion of the first drive shaft and a portion of the first drive block assembly are provided in a track of the first drive housing, and wherein the track of the first drive housing is configured such that the first drive block assembly is configured to move in a path relative to the first drive housing; and a link arm including a first end and a second end, wherein the first end of the link arm is configured to move with the slider of the first drive block assembly, and the second end of the link arm is configured to connect to said object.

2. The assembly of claim 1, wherein the first drive block assembly comprises a slider latch connected to the slider and configured to engage with the latch dog.

3. The assembly of claim 2, wherein the latch dog includes a second slot configured to engage with a first end of the slider latch, and wherein a second end of the slider latch is configured to connect with the slider.

4. The assembly of claim 3, wherein the second slot of the latch dog is L-shaped and a bottom portion of the second slot is configured to receive a portion of the first end of the slider latch.

5. The assembly of claim 4, comprising a slider latch spring configured to bias the slider latch toward the bottom portion of the second slot.

6. The assembly of claim 4, wherein the first drive housing comprises a trip wedge configured to move the first end of the slider latch out of the bottom portion of the second slot.

7. The assembly of claim 2, wherein the latch dog is configured to move independently of the slider latch when the latch dog and the slider latch are disengaged and wherein the slider latch is configured to move with the latch dog when the slider latch and the latch dog are engaged.

8. The assembly of claim 2, wherein the slider latch includes a slot and the latch dog includes a pin configured to engage with the slot of the slider latch.

9. The assembly of claim 1, wherein the first drive housing comprises a trip wedge configured to disengage the slider latch from the latch dog.

10. The assembly of claim 1, comprising a limit switch configured to stop the motor.

11. The assembly of claim 1, wherein the first slot of the latch dog has a medial axis at an angle relative to the cylindrical axis of the first drive shaft.

12. The assembly of claim 1, wherein the first slot of the latch dog includes a first portion with a first medial axis at a first angle relative to the cylindrical axis of the first drive shaft and a second portion with a second medial axis at a second angle relative to the cylindrical axis of the first drive shaft, and wherein the first angle and second angle are different.

13. The assembly of claim 1, wherein the latch dog is connected to the aperture of the first drive block assembly such that the latch dog is configured to move with the aperture in a path along the first drive shaft.

14. The assembly of claim 1, wherein the first end of the link arm is pivotally connected to the slider and the second of the link arm is pivotally connected to said object.

15. The assembly of claim 1, comprising a second drive shaft, a second drive block assembly, a second drive housing, and a drive synchronizer configured to facilitate the motor to drive the first drive block assembly and the second drive block assembly.

16. The assembly of claim 15, wherein the drive synchronizer comprises a first drive belt pulley connected to the first drive shaft, a second drive belt pulley connected to the second drive shaft, and a drive belt disposed between the first drive shaft and second drive shaft.

17. The assembly of claim 16, comprising a belt tensioner.

18. The assembly of claim 15, wherein the drive synchronizer comprises a first bevel gear connected to the first drive shaft, a second bevel gear connected to the second drive shaft, a corresponding first bevel gear, a corresponding second bevel gear, and a drive synchronizer shaft disposed between the first drive shaft and second drive shaft and connected to the corresponding first bevel gear and corresponding second bevel gear.

19. The assembly of claim 1, wherein a cross-section of the portion of the first drive block assembly provided in the track of the first drive housing has substantially the same peripheral shape as a cross-section of the track of first drive housing.

20. The assembly of claim 1, wherein the first drive shaft is threaded, and the aperture of the first drive block assembly is threaded, and wherein the rotation of the first drive shaft causes the latch dog to move along the track of the first drive housing.

* * * * *

UNITED STATES PATENT AND TRADEMARK OFFICE

CERTIFICATE OF CORRECTION

PATENT NO. : 8,677,689 B1
APPLICATION NO. : 13/735533
DATED : March 25, 2014
INVENTOR(S) : David L. Draper It is certified that error appears in the above-identified patent and that said Letters Patent is hereby corrected as shown below:

In the Claims:

Column 10, line 24, after the word "second" insert --end--.

Signed and Sealed this
Tenth Day of June, 2014

Michelle K. Lee

Michelle K. Lee
*Deputy Director of the United States Patent and Trademark Office*